US005643474A

United States Patent [19]

Sangeeta

[11] Patent Number: 5,643,474

[45] Date of Patent: Jul. 1, 1997

[54] THERMAL BARRIER COATING REMOVAL ON FLAT AND CONTOURED SURFACES

[75] Inventor: D. Sangeeta, Niskayuna, N.Y.

[73] Assignee: General Electric Company, Schenectady, N.Y.

[21] Appl. No.: 578,803

[22] Filed: Dec. 26, 1995

[51] Int. Cl.[6] ..... C23G 1/00

[52] U.S. Cl. ..... 216/96; 216/100; 216/101; 134/2; 252/79.5

[58] Field of Search ..... 216/83, 96, 100, 216/101; 134/2; 252/79.1, 79.5

[56] References Cited

U.S. PATENT DOCUMENTS

| | | | |
|---|---|---|---|
| 2,937,940 | 5/1960 | Weisberg | 216/100 |
| 3,163,524 | 12/1964 | Weisberg | 216/100 |
| 3,419,441 | 12/1968 | McAllister et al. | 216/101 |
| 3,481,877 | 12/1969 | Moll | 252/79.5 |
| 3,553,015 | 1/1971 | Dohogne | 216/100 |
| 4,134,777 | 1/1979 | Borom | 134/2 |
| 4,141,781 | 2/1979 | Greskovich et al. | 216/101 |
| 5,522,938 | 6/1996 | O'Brien | 134/2 |

OTHER PUBLICATIONS

"Ceramic Coating", Metals Handbook, Ninth Edition, vol. 5, pp. 532–547.

"Oxidation Protective Coatings for Superalloys and Refractory Metals" by Edwin S. Bartlett, pp. 375–380, Metals Handbook.

1954 Supplement to the "Metal Cleaning Bibliographical Abstracts" prepared by J.C. Harris, p. 20, 1954.

"Metal Cleaning Bibliographical Abstracts"s 1842–1951, prepared by Jay C. Harris, pp. 41 & 98, 1951.

*Primary Examiner*—R. Bruce Breneman
*Assistant Examiner*—Anita Alanko
*Attorney, Agent, or Firm*—Noreen C. Johnson; William H. Pittman

[57] ABSTRACT

The invention is directed towards a wet chemical process for removing physical vapor deposited or air plasma sprayed thermal barrier coatings from coated parts without damaging or effecting the bond coat or the base metal substrate. The process entails using an autoclave with an organic caustic solution to fully remove the thermal barrier coating.

11 Claims, 4 Drawing Sheets

BEFORE TREATMENT

AFTER TREATMENT

BEFORE TREATMENT

AFTER TREATMENT

BEFORE TREATMENT

AFTER TREATMENT

BEFORE TREATMENT

AFTER TREATMENT

THERMAL BARRIER COATING REMOVAL ON FLAT AND CONTOURED SURFACES

FIELD OF THE INVENTION

This invention is related to the removal of thermal barrier coatings from flat and contoured surfaces. In particular, this invention is related to the chemical removal of yttria-stabilized zirconia thermal barrier coatings deposited by physical vapor deposition or air plasma spray on superalloy substrates having a bond coat.

BACKGROUND OF THE INVENTION

Oxidation and corrosion protective coating development for superalloys and refractory metals has been spurred by advances in propulsion technology in turbine parts since about 1960. These advances have placed increasing temperature and structural demands on materials for service at temperatures of 1010° C. and above. Consequently, coatings are relied on to protect superalloy components such as turbine blades and vanes from environmental attack and to provide thermal barriers at the operating temperature of the superalloy component.

Improvements in the efficiency of gas turbine engines can in general best be achieved directly or indirectly by an increase in the temperature of the combustion gases incident on the turbine blades. The main constraint to the achievement of this objective is the limited choice of materials for the blades which will retain adequate strength and corrosion resistance above 1100° C. for sufficient lengths of time. New processing developments for advanced nickel-base and cobalt-base superalloys have given the engine designer new limits of strength capability at the expense of environmental corrosion resistance. Simultaneous advances in coating technology have gone some way in achieving a satisfactory balance of materials requirements. However, further increases in gas temperature up to and even beyond 1600° C. are still required. To meet this problem refractory alloys and ceramics must be considered as potential materials for advanced engines and progress towards reducing metal temperature is desired.

The principle of applying a low thermal conductivity ceramic, a thermal barrier coating, to a metal substrate as a means of thermal insulation has been recognized for some time. Many of the problems which have arisen in the past have been associated with metal substrate/ceramic compatibility. Differences in thermal expansion between the alloy and oxide invariably cause spallation of the thermal barrier layer. Adhesion of the ceramic composition to the substrate has posed further problems. Many of these initial limitations have been overcome by applying to the substrate a first so-called bond coat, e.g. of molybdenum, nickel-chrome, or MCrAlY, where M is nickel, cobalt, iron or mixtures thereof, followed by the preferred refractory oxide barrier layer, usually comprising some form of stabilized zirconia. Zirconia stabilized with either calcia, hafnia, magnesia, yttria, or any of the rare earth oxides may be used as a barrier oxide due to its very low thermal conductivity, low density and high melting point.

Engines for commercial aircraft, some military aircraft, and power generation service that have thermal barrier coatings eventually crack, spall, or undergo chemical and physical attack during their service life. Overhauls of these coatings are usually done periodically. During overhaul, turbine blades and vanes that have not exceeded creep limits and are not otherwise severely eroded or damaged are refurbished for reuse. Coatings, such as thermal barrier coatings and bond coats, are stripped from the components. The components are reworked and cleaned as necessary, recoated, and returned to service.

The thermal barrier coating repair on jet engine or power generation parts involves complete removal of thermal barrier coatings before recoating the surfaces with fresh thermal barrier coating and bond coat. The grit blasting method currently used to remove thermal barrier coatings is a labor intensive and time consuming process. In addition, it damages the bond coat as well, so that both the thermal barrier coating and the bond coat need to be refurbished. Also, repeated removal of bond coats thins the walls of the airfoils and increases the hole sizes in multihole blades thus increasing the airflow through the blades. As a result, only one full strip is allowed for repairing blades. Thus, there is a need to provide a process to remove thermal barrier coatings from parts without attacking or damaging the underlying bond coat or substrate.

SUMMARY OF THE INVENTION

This invention satisfies the need by providing a method for removing thermal barrier coatings from flat and contoured surfaces comprising the step of: treating the thermal barrier coated surface in an autoclave with an organic caustic solution at a temperature, a pressure, and a time sufficient to completely remove the thermal barrier coating from the surface without damaging an underlying bond coat or a substrate surface. During the process it is beneficial, but not necessary, if the organic component of the organic caustic solution acts as a supercritical fluid. By supercritical fluid it is meant that the liquid is above its critical temperature and pressure where the surface tension of the organic solution is near or about zero.

The thermal barrier coating is generally a chemically stabilized zirconia, such as yttria stabilized zirconia, calcia stabilized zirconia, or magnesia stabilized zirconia. Other oxide or ceramic coatings that act as thermal barriers may also be referred to as thermal barrier coatings for the purpose of this invention. Herein, bond coats are usually meant to be metallic compositions, including platinum-aluminum, aluminum, aluminum-nickel, nickel-chromium-aluminum-yttrium, iron-chromium-aluminum-yttrium, cobalt-chromium-aluminum-yttrium, and nickel-cobalt-chromium-aluminum-yttrium.

Substrate materials often used in turbines for aircraft engines and power generation equipment may be nickel, chromium, or iron based superalloys. The alloys may be cast or wrought superalloys. Examples of such substrates are GTD-111, GTD-222, Rene 80, Rene 41, Rene 125, Rene 77, Rene 95, Inconel 706, Inconel 718, Inconel 625, cobalt-based HS188, cobalt-based L-605, and stainless steels. The process is especially suited for thermal barrier coated parts and hardware used in turbines or on airfoils. An example of a turbine part would be a turbine blade or vane. The term airfoil refers also to turbine parts, such as blades, vanes, buckets, nozzles, and the like.

Additional substrate materials, that can accommodate a thermal barrier coating for applications other than turbine parts, may be used in this invention. For instance, it is also contemplated that this invention may be utilized for removal of thermal barrier coatings in marine environments, electronic applications, and power generators, such as gas, steam, and nuclear, to mention a few.

Organic caustic solutions comprise chemical admixtures of an organic compound, such as an alcohol, a basic compound, such as an hydroxide base, and water. The ratio of base to water may be about one to one (1:1), or fifty weight percent base in water. The organic compound, generally a solvent to reduce surface tension of the solution, such as ethanol, must be present in a sufficient amount to cause all of the thermal barrier coating to be removed from the treated part. The thermal barrier coating detaches from the coated part in whole or fragmented pieces.

An advantage of the invention is that the underlying bond coat and substrate are not damaged, which allows multiple repairs on the airfoils. This is a substantial savings in refurbishing time and costs. Another advantage of the invention is that all of the thermal barrier coating is removed from both flat and contoured surfaces. Still another advantage of this invention is that plain caustic treatment of TBC parts requires higher concentration of inorganic bases to dissolve the thermal barrier coatings, whereas the organic caustic treatment requires much lower concentrations.

DESCRIPTION OF THE INVENTION

Figure 1A:
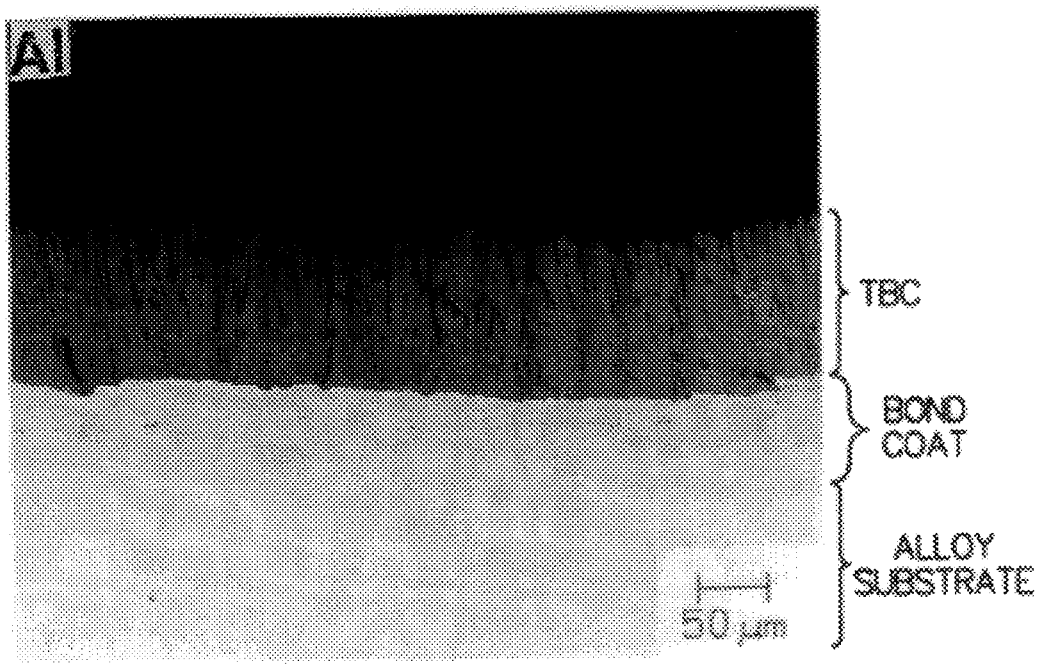
FIGS. 1*a* and 1*b* are photo micrographs of a thermal barrier coating on an aluminum bond coat before and after the organic caustic treatment in the autoclave exhibiting complete removal of the thermal barrier coating without affecting the bond coat.
Figure 1B:
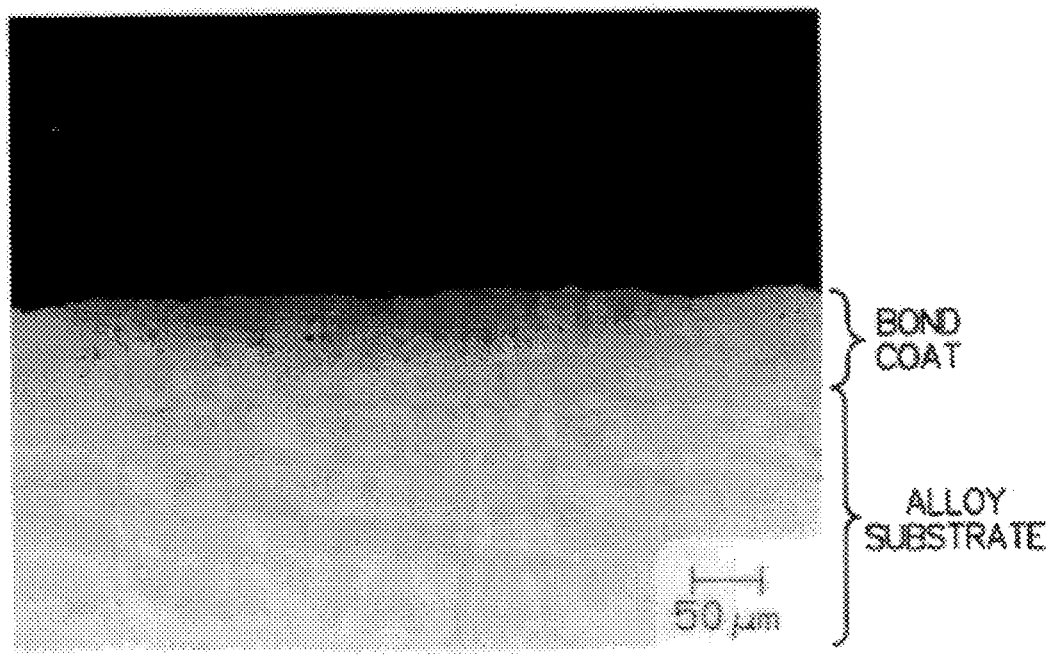
Figure 2A:
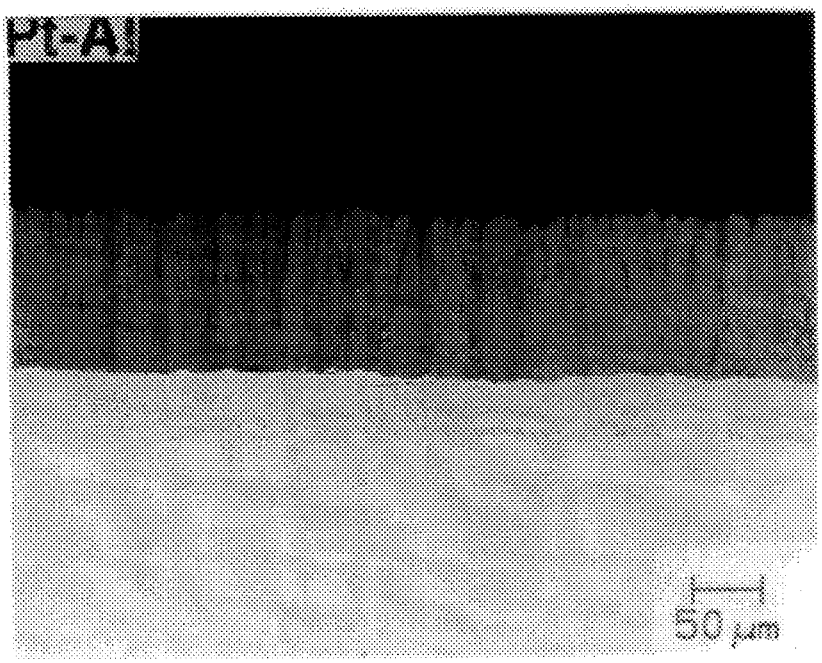
FIGS. 2*a* and 2*b* are photo micrographs of a thermal barrier coating on a platinum aluminide bond coat before and after the organic caustic treatment in the autoclave exhibiting complete removal of the thermal barrier coating without affecting the bond coat.
Figure 2B:
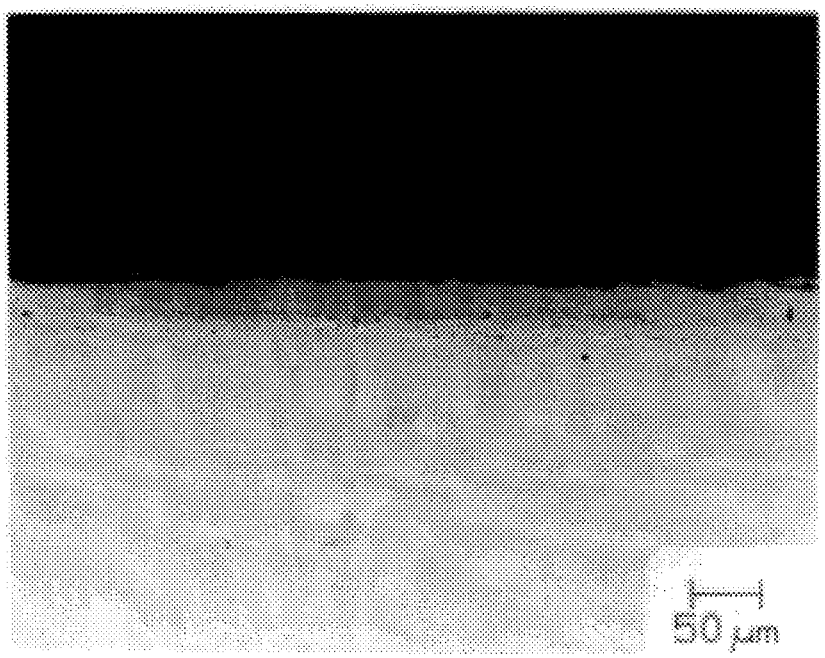

The invention is directed towards a wet chemical process for removing physical vapor deposited or air plasma sprayed thermal barrier coatings from coated parts without damaging or effecting the bond coat or the base metal substrate. The process entails using an autoclave with an organic caustic solution to fully remove the thermal barrier coating.

The autoclave reactor is a pressure vessel and is built to withstand high pressures at high temperatures. Pressure in the system is elevated by heating the contents (reaction mixture) in the autoclave or by using an external source of compressed gases to overpressurize the vessel. The autoclave may be operated in batch fashion; that is, the ingredients of the caustic organic solution are charged, the unit is closed, and the charge is brought to the desired conditions of temperature and pressure. Continuous or semicontinuous operation can be undertaken if one or more of the reactants are continuously fed and products withdrawn.

In the autoclave, the temperature and pressure that is applied may cause the organic component of the organic caustic solution to become a supercritical fluid or have properties similar to that of a supercritical fluid. By supercritical fluid it is meant that the surface tension of the fluid is zero or approaches near zero which completely wets the surfaces in contact. The organic caustic solution does not have to be a supercritical fluid for the thermal barrier coating to be removed. However, if the organic component of the organic caustic solution is near or approaches a supercritical state in the autoclave reactor during treatment of the thermal barrier coated part, the surface tension is reduced thus enhancing the activity of the organic caustic solution and its wettability towards fine cracks and pores.

The organic caustic solution is generally an admixture of an organic compound, a base, and water. Other admixtures may also be used, such as acetone, liquid ammonia, or liquid carbon dioxide, provided they dramatically lower the surface tension of the fluid during treatment of the thermal barrier coated part in the autoclave. Examples of organic compounds are alcohols, such as methanol, ethanol, propanol, isopropyl alcohol, and acetone and liquid carbon dioxide, and mixtures thereof. Examples of caustic compounds are sodium hydroxide, potassium hydroxide, ammonium hydroxide, lithium hydroxide, triethylamine (TEA), tetramethylammonium hydroxide (TMAH), and mixtures thereof. Use of additives, such as surfactants and chelates, to further reduce the surface tension of the caustic solution can be beneficial. The caustic compound and the water may be present in about a one to one ratio. The concentrations of the bases may range from very dilute, about one weight percent, to very concentrated, about sixty-five weight percent. The organic compound is usually present in a sufficient amount as a solvent media for the caustic solution to fully remove the thermal barrier coating from the coated part. The amount also depends on the size of the autoclave reactor and the size of the part being processed. Commonly known engineering principles can be used to calculate various amounts of the organic compound that is sufficient with the caustic and water to remove the thermal barrier coating. Generally, the base is about 1–65 weight percent, the water is about 1–35 weight percent, and the organic compound is about 1–98 weight percent. A preferred weight percent for the caustic organic solution is about 6 weight percent base, 6 weight percent water, and about 88 weight percent organic compound.

The temperature and pressure that is used during treatment can vary, depending on the amount and the type of thermal barrier coating to be removed and the capabilities of the autoclave reactor. The organic caustic treatment can be performed at a range of temperatures, pressures, and reaction times. For example, the treatment may involve combinations of ultrasonication, mechanical mixing, and boiling with an autoclave treatment. The autoclave treatment can be conducted under several conditions. For instance, the pressure can range from about 100 pounds per square inch to about 3000 pounds per square inch, and the temperature can range from about 150° C. to 250° C. Higher pressures and temperatures can be applied to achieve shorter process times. Also, pressurization can be achieved at room temperature using compressed gases. Still yet, the process can start with zero pressure and by increasing the temperature of the reaction mixture, the autoclave pressure automatically rises resulting from the increase in the vapor pressure of the reaction mixture. The time to remove the thermal barrier coating depends on the amount of the coating to be removed and the temperature and pressure conditions that are applied. Usually, the time is between about 0.1 to 8.0 hours. Also, it should be noted that using a mixer, such as a mechanical stirrer, a magnetic stirrer, or an ultrasonicator, at low pressures or high pressures may enhance the ability of the organic caustic solution to remove the thermal barrier coating in torcherous locations and within a shorter duration of time.

Examples of one of the organic caustic autoclave treatments of thermal barrier coated samples is now described for purposes of demonstrating the invention, and does not limit the invention to only this one treatment or set of conditions. An organic caustic solution containing about fifteen grams of sodium hydroxide, about fifteen grams of water, and about one hundred twenty-five milliliters of ethanol were admixed by stirring at room temperature, which resulted in a clean to cloudy solution and an exothermic reaction. The following samples were placed in a Motel autoclave with the organic caustic solution:

1.) Physical vapor deposited thermal barrier coating (8% yttria stabilized 92% zirconia) on a vapor deposited aluminum bond coat with a N-5 base metal substrate.

2.) Physical vapor deposited thermal barrier coating (8% yttria stabilized 92% zirconia) on a packed aluminum bond coat with a N-5 base metal substrate.

3.) Physical vapor deposited thermal barrier coating (8% yttria stabilized 92% zirconia) on a packed platinum-aluminum bond coat with a N-5 base metal substrate.

4.) Rene' N-5 substrate blank.

5.) Rene' 142 substrate with platinum-aluminum bond coat.

The autoclave was sealed and pressurized to 1000 pounds per square inch using compressed air and the setup was left for an hour to ensure no leakage in the system. Before beginning the experiment the autoclave pressure was reduced to atmospheric pressure, and then the temperature was raised to 260° C. which resulted in a pressure rise to approximately 1800 pounds per square inch pressure and the conditions were maintained for about one hour. At this temperature, ethanol is expected to be a supercritical fluid with increased mobility and higher solubility. The samples were removed after the autoclave was cooled down and the pressure was released. The samples were cleaned in an ultrasonicator with water followed by an acid wash (5 weight percent hydrochloric acid) to neutralize leftover base. The samples were further washed in water and dried in an oven. The samples were then analyzed for weight loss, curvature change, and microstructural changes.

Five different experiments were conducted to demonstrate the feasibility of using the organic caustic autoclave treatment to remove thermal barrier coatings (TBC). The following examples give the results of the experiments.

EXAMPLE 1

Organic Caustic Treatment: 15 grams sodium hydroxide, 15 grams of water, and 125 milliliters of ethanol for two hours at supercritical conditions.

TABLE 1

| Sample # | Sample Composition | Weight (before treatment) | Weight (After treatment) (% Wt. Loss) | Curvature (before treatment) | Curvature (after treatment) |
|---|---|---|---|---|---|
| 1 | TBC/A1 bond coat | 7.142 g | 6.970 g (2.4%) | — | — |
| 2 | TBC/Pt-A1 bond coat | 7.374 g | 7.206 g (2.3%) | — | — |
| 3 | TBC/Pt-A1 bond coat | 6.772 g | 6.594 g (2.6%) | — | — |
| 4 | Rene, N-5 | 13.887 g | 13.886 g (None) | 0.00353 | 0.00344 |
| 5 | Rene, 142 w/Pt-A1 bond coat | 14.088 g | 14.069 g (0.13%) | −0.00229 | −0.00249 |

The above organic caustic treatment of thermal barrier coated samples in the autoclave was successful in cleanly removing the thermal barrier coating layers without damaging the substrate or the bond coat. The thermal barrier coatings on the sides of the specimen were also successfully removed.

The N-5 blank exhibited no change in weight and a negligible change in curvature. Rene'142 with Pt—Al bond coat exhibited a weight loss of 20 mg with negligible curvature change. Assuming a density of 9 g/cc for the Pt—Al bond coat (50 μm thick), the weight loss corresponds to 8.2 weight percent of the bond coat. The estimated weight loss of 8.2% indicates damage to the bond coat. However, as shown in FIGS. 1*a–b* and 2*a–b*, the microstructure of the cross section of the samples before and after the treatment exhibit clean removal of thermal barrier coating without damaging the bond coat. The bond coat thickness in the samples remained unchanged after the treatment. In addition, no change in the microstructure of the bond coat was observed. Further analysis with the electron microprobe was conducted to determine any loss of metals from the bond coat or the substrate. Approximate depth of 120 μm from the bond coat surface was analyzed indicating no loss of metals (platinum, aluminum, nickel, chromium, etc.) from the samples. The above investigation indicates that the 8.2 weight percent loss from the bond coat may have included dirt or the weight numbers calculated for the bond coat are inaccurate. To verify the above analyses, the weight of the bond coat can be experimentally determined by measuring the weight of the substrate before and after the bond coat deposition. Successful treatments have been carved out on mutlihole blades to remove TBCs from new, remake, and serviced blades.

EXAMPLE 2

Plain Caustic: 50 weight % NaOH in $H_2O$/2 hours at 285° C./2000 psi

An experiment was conducted to study the effectiveness of plain caustic without alcohol to remove TBCs and the results are summarized in the table below:

TABLE 2

| Sample # | Sample Composition | Weight (before treatment) | Weight (After treatment) (% Wt. Loss) | Curvature (before treatment) | Curvature (after treatment) |
|---|---|---|---|---|---|
| 6 | TBC/A1 bond coat | 6.831 g | 6.589 g (3.6%) | — | — |
| 7 | TBC/Pt-A1 bond coat | 5.601 g | 5.359 g (4.2%) | — | — |
| 8 | TBC/Pt-A1 bond coat | 6.570 g | 6.399 g (2.6%) | — | — |
| 9 | Rene, N-5 | 13.867 g | 13.853 g (0.1%) | 0.00471 | 0.00417 |
| 10 | Rene, 142 w/Pt-A1 bond coat | 14.309 g | 14.219 g (0.6%) | 0.00867 | 0.00592 |

The samples including blanks (9 and 10) indicated higher weight loss compared to the previous autoclave run with organic caustic solution. Higher curvature change was observed for the sample with the bond coat (10) indicating bond coat damage.

Figure 3A:
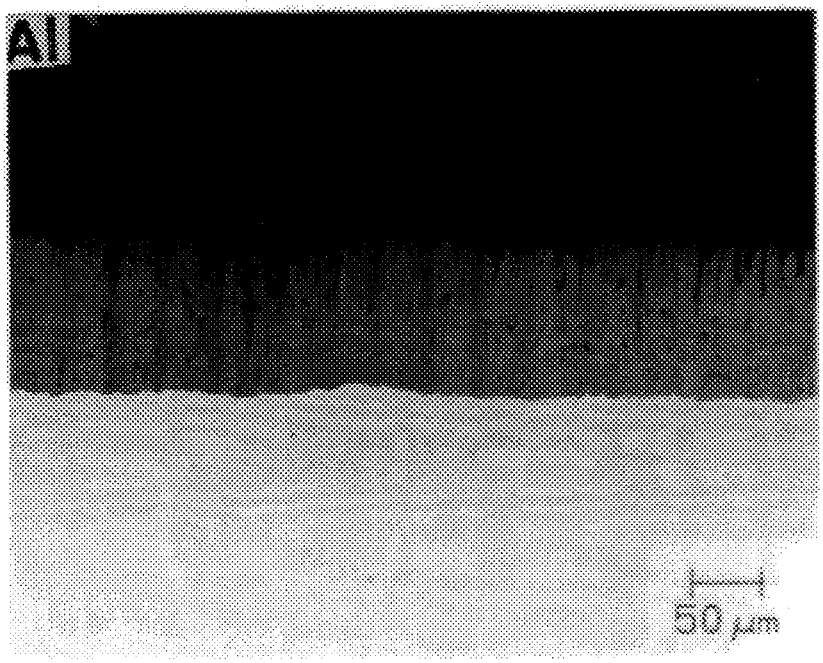
FIGS. 3*a* and 3*b* are photo micrographs of a thermal barrier coating on an aluminum bond coat before and after the plain caustic treatment without organic solvents in the autoclave exhibiting damage to the bond coat.
Figure 3B:
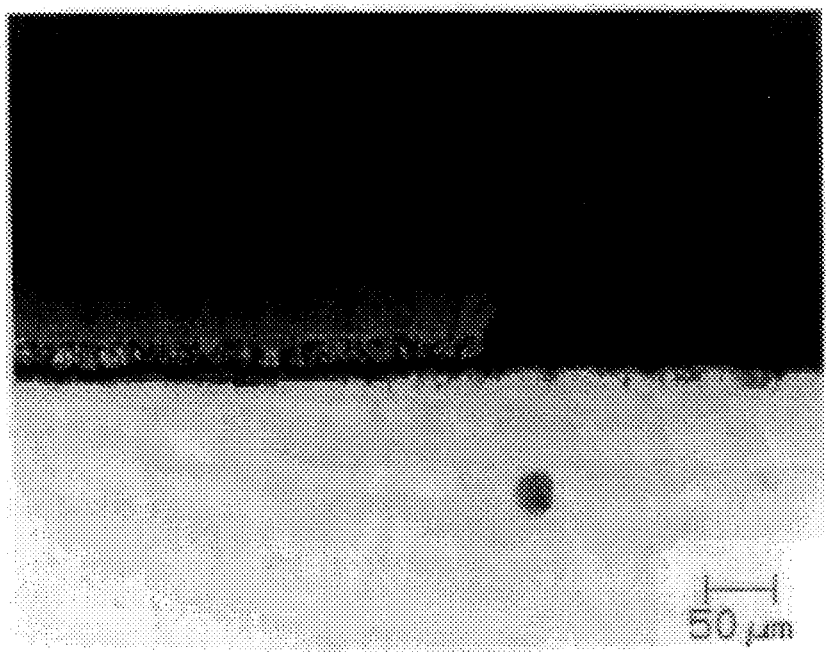
Figure 4A:
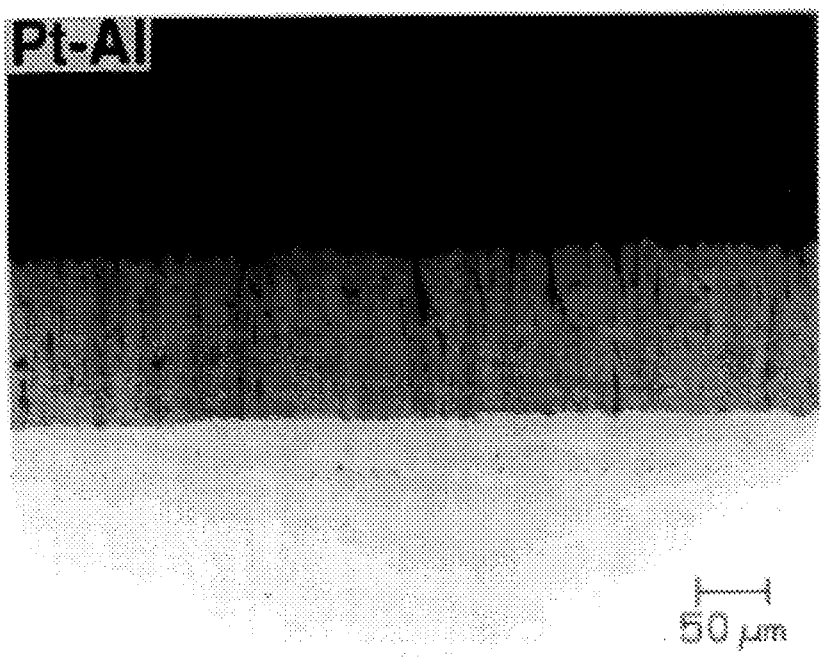
FIGS. 4*a* and 4*b* are photo micrographs of a thermal barrier coating on a platinum aluminide bond coat before and after a plain caustic treatment without organic solvent in the autoclave exhibiting damage to the bond coat.
Figure 4B:
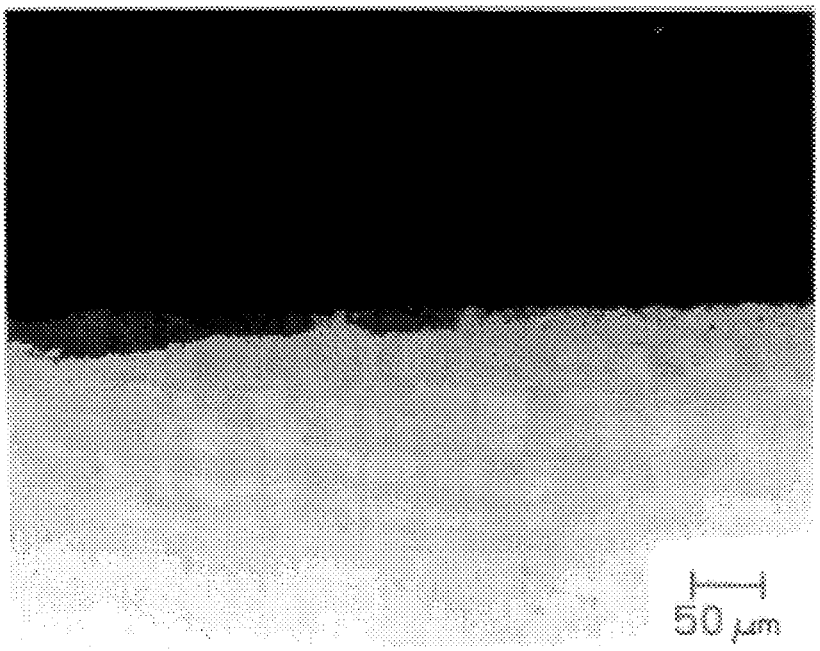

The optical microscopy of the cross section of the above samples exhibited damage to and loss of some of the bond coat. The sample with Pt—Al bond coat exhibited discoloration and damage to the bond coat (see FIGS. 4*a* and 4*b*). However, samples with Al bond coat exhibited loss of the bond coat in several locations (see FIGS. 3*a* and 3*b*). In conclusion, this process is not selective towards removing thermal barrier coatings since this process damages the bond coat as well.

EXAMPLE 3

In another experiment, samples were treated in an autoclave with straight ethanol at the critical point (approximately 250° C., 1800 psi). The samples exhibited no change and thermal barrier coatings on the substrates were not removed.

EXAMPLE 4

Reduced concentration of the Organic Caustic: 7.5 g NaOH/7.5 g $H_2O$/125 mL EtOH/1.5 hours at critical point.

In an effort to use milder chemical etching solution, the concentration of the caustic used in experiment 1 was reduced to half and the results are summarized in the table below.

TABLE 3

| Sample # | Sample Composition | Weight (before treatment) | Weight (After treatment) (% Wt. Loss) | Miscellaneous |
|---|---|---|---|---|
| 11 | TBC/A1 bond coat | 7.318 g | 7.122 g (2.7%) | bond coat intact |

TABLE 3-continued

| Sample # | Sample Composition | Weight (before treatment) | Weight (After treatment) (% Wt. Loss) | Miscellaneous |
|---|---|---|---|---|
| 12 | TBC/Pt-A1 bond coat | 6.706 g | 6.533 g (2.6%) | bond coat intact |
| 13 | TBC/Pt-A1 bond coat | 6.779 g | 6.585 g (2.9%) | bond coat intact |

The results of this experiment were similar to experiment 1 where the thermal barrier coating was removed without attacking the bond coat. Some discoloration of the bond coat was observed but the optical microscopy did not indicate any change in the bond coat. Discoloration may have resulted from the cleaning process after the autoclave treatment.

The same treatment was applied to the multihole jet engine blade with physical vapor deposited thermal barrier coating and the coating was removed from surface and holes without damaging the platinum aluminum bond coat.

EXAMPLE 5

In an effort to use milder operating conditions, the samples were submerged in an organic caustic solution and were sonicated in an ultrasonicator instead of treating in an autoclave at high temperature and pressure. The samples did not exhibit any changes and the thermal barrier coating remained intact, thus indicating the need for higher pressure to effectively remove the TBCs.

I claim:

1. A method for removing thermal barrier coatings from flat and contoured surfaces comprising the step of: treating the thermal barrier coated surface in an autoclave with an organic caustic solution at a temperature, a pressure, and a time sufficient to completely remove the thermal barrier coating from the surface without damaging an underlying bond coat or a substrate surface.

2. A method according to claim 1 where the thermal barrier coating is a chemically stabilized zirconia selected from the group consisting of yttria stabilized zirconia, calcia stabilized zirconia, magnesia stabilized zirconia, and mixtures thereof.

3. A method according to claim 2 where the thermal barrier coating is about 8 weight percent yttria stabilized about 92 weight percent zirconia.

4. A method according to claim 1 where the organic caustic solution comprises an organic compound, a base, and water.

5. A method according to claim 4 where the organic compound is a solvent selected from the group consisting methanol, ethanol, propanol, isopropyl alcohol, acetone, liquid carbon dioxide, liquid ammonia, and mixtures thereof.

6. A method according to claim 4 where the base is a inorganic base or an organic base, where the base is selected from the group consisting of sodium hydroxide, potassium hydroxide, lithium hydroxide, ammonium hydroxide, triethylamine, tetramethylammonium hydroxide, and mixtures thereof.

7. A method according to claim 1 where the pressure is between about 100 psi to 3000 psi, where the temperature is between about 150°–250° C., and where the time is between about 0.1–8.0 hours.

8. A method according to claim 1 where the bond coat is a metal composition selected from the group consisting of aluminum, platinum aluminum, nickel aluminum, nickel-chromium-aluminum-yttrium, iron-chromium-aluminum-yttrium, cobalt-chromium-aluminum-yttrium, nickel-cobalt-chromium-aluminum-yttrium, and mixtures thereof.

9. A method according to claim 1 where the substrate is a nickel, chromium, or iron based superalloy selected from the group consisting of GTD-111, GTD-222, Rene 80, Rene 41, Rene 125, Rene 77, Rene 95, Inconel 706, Inconel 718, Inconel 625, cobalt-based HS188, cobalt-based L-605, and stainless steels.

10. A method according to claim 4 where the organic caustic solution is about 1–98 weight percent organic compound, about 1–65 weight percent base, and about 1–35 weight percent water.

11. A method according to claim 5 where the organic compound approaches a supercritical fluid state during the treatment of the thermal barrier coated surface in the autoclave.

* * * * *